United States Patent [19]

Youngberg

[11] 3,963,408

[45] June 15, 1976

[54] PRECOMBUSTION CONDITIONING DEVICE FOR INTERNAL COMBUSTION ENGINES

[75] Inventor: Charles A. Youngberg, Prairie View, Ill.

[73] Assignee: F. D. Farnum Co., Lyons, Ill.

[22] Filed: Apr. 29, 1975

[21] Appl. No.: 570,075

Related U.S. Application Data

[63] Continuation-in-part of Ser. No. 468,090, May 8, 1974, abandoned.

[52] U.S. Cl. ..... 431/2; 123/119 E; 261/1

[51] Int. Cl.[2] ..... F23B 7/00

[58] Field of Search ..... 123/119 E, 141; 261/1; 431/2

[56] References Cited

UNITED STATES PATENTS

| | | | |
|---|---|---|---|
| 1,333,836 | 3/1920 | Csanyi | 123/119 E |
| 1,939,302 | 12/1933 | Heaney | 123/119 E |
| 2,576,450 | 11/1951 | De Marval | 123/119 E |
| 2,705,941 | 4/1955 | Unschild | 123/119 E |
| 3,266,783 | 8/1966 | Knight | 123/119 E |
| 3,749,545 | 7/1973 | Velkoff | 123/119 E |
| 3,885,539 | 5/1975 | Hicks | 123/119 E |

*Primary Examiner*—Wendell E. Burns
*Attorney, Agent, or Firm*—Mann, Brown & McWilliams

[57] ABSTRACT

A precombustion conditioning device for gasoline fired internal combustion engines comprising at least one cupped or dished foraminous member disposed across the fuel-air intake passageway of the engine between the carburetor and fuel-air inlet of the engine, and mounted in a carrier formed from an electrically insulating material that also carries an electrogenetic direct current power surce, with the foraminous member being electrically connected to the positive terminal of the direct current power source and the negative terminal of the power source being connected to the engine and hence the inside wall of the intake manifold. The mixture of air and gasoline passes through the positively charged foraminous member where the liquid gasoline particles involved, through contact, become positively charged, whereby the positively charged particles repel each other and in passing into the engine intake manifold are attracted to and against the negatively charged interior walls of the manifold and engine to be spread out in thin layers for maximized evaporation of the gasoline, with resultant improved engine performance, gasoline mileage, and reduction of pollutants.

28 Claims, 9 Drawing Figures

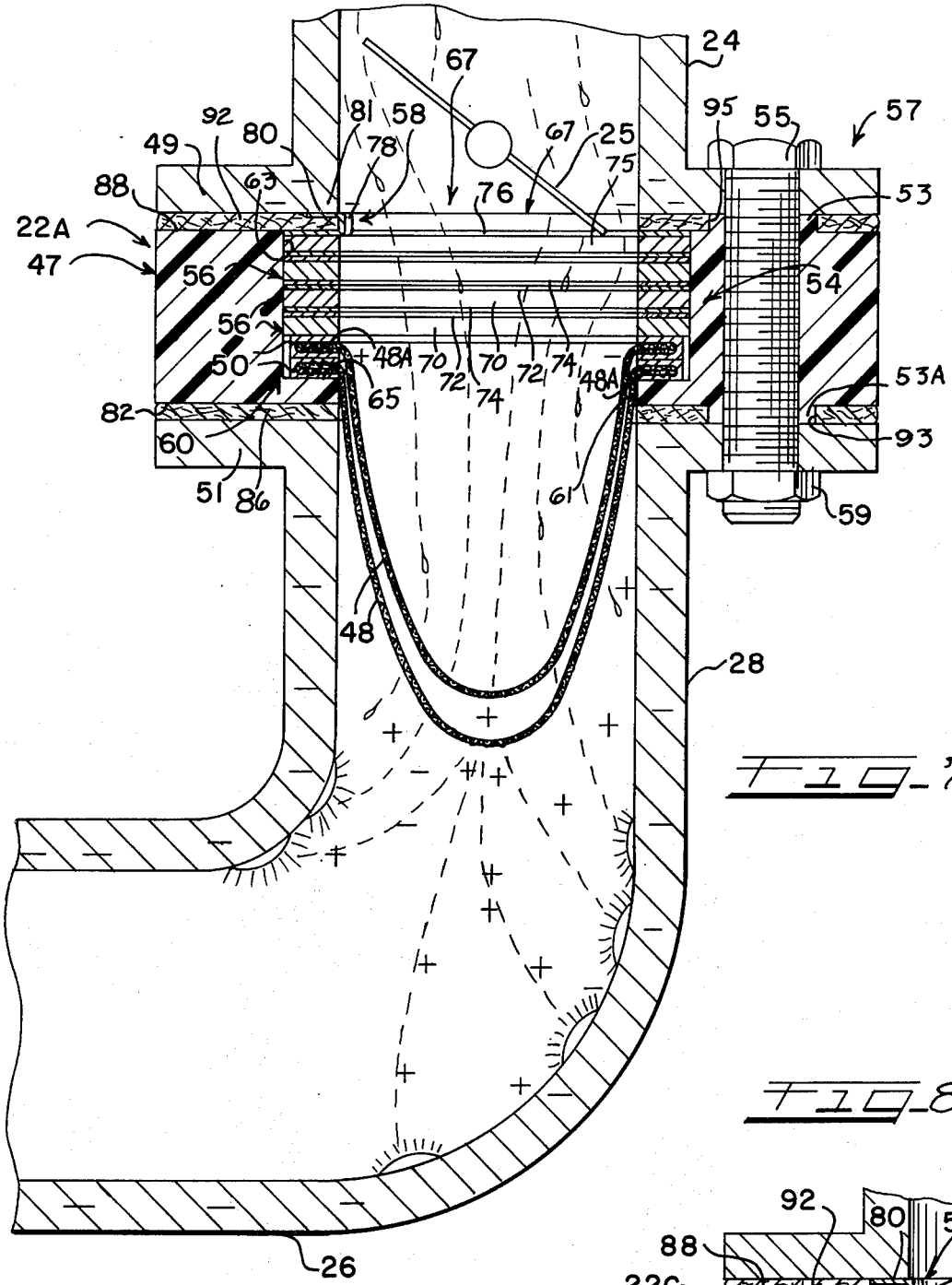
FIG. 7
FIG. 8
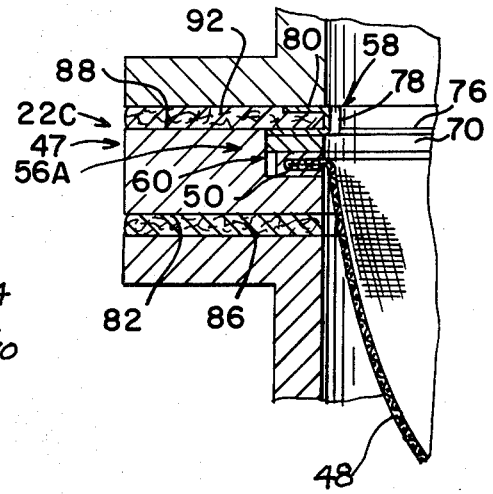
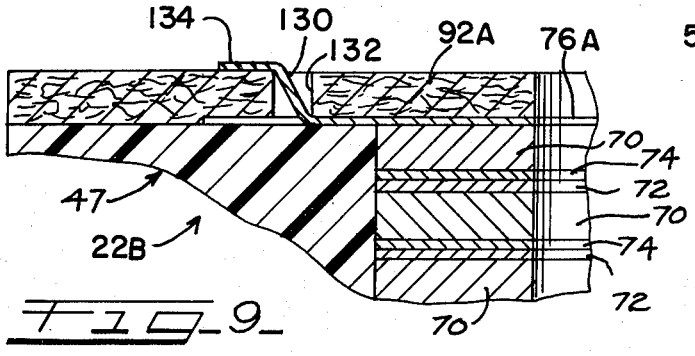
FIG. 9

PRECOMBUSTION CONDITIONING DEVICE FOR INTERNAL COMBUSTION ENGINES

This application is a continuation-in-part of application Ser. No. 468,090, filed May 8, 1974, now abandoned, the disclosure of which is hereby incorporated herein by this reference.

This invention relates to a precombustion conditioning device for internal combustion engines, and more particularly, to a precombustion conditioning device for gasoline fired internal combustion engines for improving combustion and gasoline mileage.

Modern problems of pollution control and fuel shortages have made urgent the need for the finding of more efficient ways of fueling internal combustion engines, and this is particularly true of gasoline engines, especially those designed for automobile use. Gasoline consumption efficiency improvements in the past have, in general, been concerned with the engine itself, such as providing higher compression ratios with consequent increase in theoretical and actual cycle efficiency, better firing, better combustion chamber design, and freer flow of gases. However, modern pollution control approaches to automobile pollution problems currently involve such things as exhaust gas catalysts and pollution control valves which tend to negate the effect of many improvements built into gasoline engines for engine efficiency purposes.

More recntly attempts to economize on automobile fuel consumption have been directed to reducing car size and weight and utilizing smaller, more efficient engines, for future automobiles models. However most of the newer automobiles currently in operation, which were disigned before present fuel scarceties became urgent, have many years of operating life remaining. It is therefore particularly desirable to provide for more efficient fuel consumption for both existing and future automobiles.

A principal object of the present invention is to provide a precombustion conditioning device that conditions the fuel-air mixture for maximum combustion before the fuel-air mixture enters the engine cylinders, utilizing electrostatic principles for effective vaporization of the gasoline in the fuel-air mixture.

Another principal object of the invention is to provide an electrostatic precombustion conditioning device that effects a positive charging of the fuel particles in the fuel-air mixture prior to the entry of the mixture into the engine manifold, and an opposite charging of the manifold itself, for biasing the movement of the fuel particles to effect substantially full vaporization of the fuel Yet another object of the invention is to provide a precombustion conditioning device that utilizes the fast acting charging action of electrostatics to provide maximized vaporization of the fule prior to entry of same into the engine cylinders.

Still another object of the invention is to provide an automobile fuel precombustion conditioning device that is effective for cold starts, heavy engine loads, and high engine speeds.

Yet still another important object of the invention is to provide a precombustion conditioning device especially adapted for gasoline fired engines which reduces the amount of undersirable pollutants in the engine exhaust, increases mileage per gallon of gasoline, and enables less expensive gasoline of lower octane rating to be employed without inducing knocking.

Furthur objects of the invention are to provide a precombustion conditioning device especially suited for gasoline fired automobile engines that is composed of few and simple parts, that is self contained in nature and requires no external power source, that is economical of manufacture, that is convenient to install, and that is long lived and reliable in use.

In accordance with the invention, there is interposed between the carburetor and fuel-air mixture intake of the engine a foraminous member that is dished or cupped in the direction of fluid flow, and through which the fuel-air mixture is directed. The foraminous member is provided with a circumambient flange portion that is mounted in an open centered carrier formed from an electrically insulating material which is shaped to be applied in gasket like manner between the clamping flanges at the carburetor outlet and the engine air intake manifold inlet. The foraminous member preferably is in the form of a screen formed from any suitable electrically conductive material, such as steel, copper, stainless steel, or other ferrous or non-ferrous electrically conductive metals. The carrier also includes a built in source of direct current power in the form of a battery of one or more electrogenetic voltage developing units in annular form and stacked together in series circuit relation within the carrier and including a positive terminal electrically connected to the screen to positively charge the screen and negative terminal electrically connected to the carburetor that is in turn grounded to the manifold. For four cycle engines the battery assembly provides the screen with a positive charge that preferrably is at least about two volts, relative to the negatively charged manifold, for four cycle engines, but which is effective at a positive charge of 0.5 volt for small two cycle engines.

The screen forming the foraminous member preferably has a mesh size in the range of from about 10 to about 30, with the distance between wires across the mesh openings being approximately 0.025 to 0.090 inch. Wire diameters of 0.007 to 0.012 inch are generally optimum. The screen further is arranged to avoid icing by being plated with a metal that in the presence of hydrocarbons induces by catalytic effect oxidation of hydrocarbons, thereby generating sufficient heat to avoid ice build up in the screen. Metals suitable for this purpose are gold, platinum and ferritic trivalent stainless steel.

In operation, the positively charge foraminous member positively charges the liquid gasoline particles of the fuel-air mixture as the latter sweeps by and through the foraminous member, by electrostatic contact charging of the particles. As the mixiture of positively charged liquid gas particles and air moves on into the intake manifold, the positively charged liquid particles repel each other and are attracted to and impinge against the negatively charged walls of the intake manifold and engine. This spreads the liquid gasoline particles out thinly over the manifold surfaces involved so that the turbulent air flow and partial vacumn conditions involved, together with the engine heat involved, achieve maximized vaporization of the gasoline for more uniform distribution to the engine cylinders and cleaner burning characteristics. The result is a smoother running engine, freedom from carbon deposits, and improved gas mileage.

Furthermore, the electrical charge provided is electrogenetically developed by the device without the application of external power. The general arrangment is of few and simple parts and is trouble free in application.

Other objects, uses and advantages will be obvious or become apparent from a consideration of the following detailed description and the application drawings in which like reference numerals indicate like parts throughout the several views.

In the drawings:

FIG. 7 is a diagrammatic view, similar to that of FIG. 4, but illustrating a modified form of the invention, and the fuel-air flow through the device with this view providing an indication of the manner in which the fuel flow is effected by the practice of the invention;

FIG. 8 is a view similar to that of FIG. 3 but illustrating a simplified form of the invention; and FIG. 9 is a view similar to that of FIG. 3 but illustrating another modified form of the inveintion.

However, it is to be understood that the specific drawing illustrations provided are supplied primarily to comply with the requirements of the Patent Laws, and that the invention is susceptible of other embodiments that will be obvious to those skilled in the art, and that are intended to be covered by the appended claims.

Figure 1:
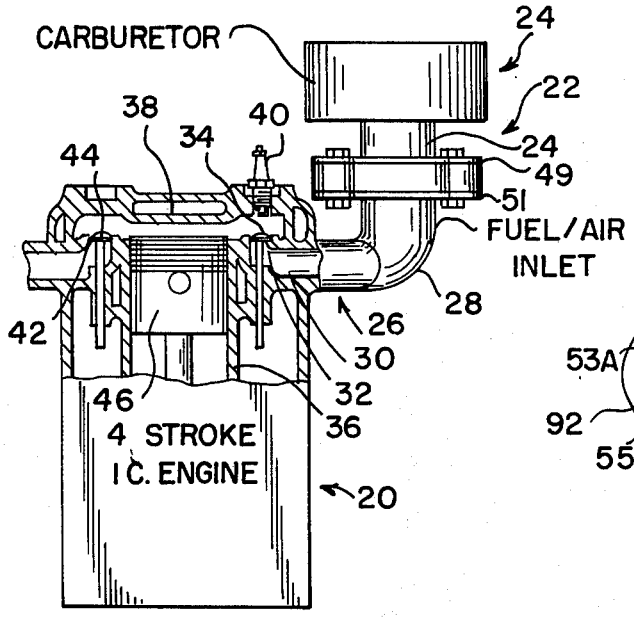
FIG. 1 is a diagrammatic elevational view, partially in section, of familiar parts of a gasoline four stroke internal combustion engine, showing the location of one embodiment of the invention between the engine carburetor and the fuel-air inlet of the engine.

Referring to FIG. 1, reference numeral 20 generally indicates a conventional gasoline fired four stroke cycle internal combustion engine, of the general type employed in connection with automobiles, with which there is associated a precombustion conditioning device 22 arranged in accordance with the present invention.

The device 22 is interposed between the carburetor 24 and the fuel-air inlet 26 to the engine 20 and more specifically, the device 22 is interposed between the outlet of the carburetor 24 (provided with the usual throttle butterfly 25) and the inlet to the engine intake manifold 28 that forms the inlet 26. The manifold 28, as customary with engines of the type indicated, has several delivery branches each terminating at different engine intake port 30 (only one of which is shown for illustrative purposes) for the respective engine cylinders 36. As is conventional, the engine intake ports 30 each lead to an intake valve seat 32 with which there is operatively associated an intake valve 34 that intermittently opens and closes the opening defined by the valve seat 32 in the well-known manner as part of the operation of four stroke cycle internal combustion engines. Each intake valve 34 is, of course, operatively associated with a different cylinder 36 having a cylinder head 38 in which a spark plug 40 is operatively mounted. Each cylinder is operatively associated with an outlet valve seat 42 that is periodically opened and closed by an outlet valve 44 that leads to a port (not shown) opening into an exhaust manifold (not shown) which conventionally is connected to the usual exhaust pipe. Each cylinder has a piston 46 reciprocable therein or operatively connected to the usual engine crank shaft for driving same. The construction of the various engine parts may be in accordance with any conventional arrangement and the motor specifically shown has been illustrated for the purpose of showing a typical application of the invention and indicating those parts of a typical four stroke cycle internal combustion engine with which the device 22 cooperates in accordance with the invention.

It is assumed that the carburetor 24 includes the usual throttle butterfly valve member 25 (diagrammatically illustrated in FIG. 7), and means for regulating the supply of fuel to the mixing chamber of the carburetor. The fuel the Applicant is primarily concerned with is gasoline, which typically is a blend principally composed of various vaporizable volitizable liquid hydrocarbons as, for example, iso-octane, hydrocarbon of high antiknocking value (100 on the octane scale), and normal heptane, a hydrocarbon of low antiknocking value (which is zero on the octane scale).

As is well known, the gasoline fuel employed is sprayed in the form of small particles into the airstream moving the carburetor where the fuel and air mixed to form the mixture that is to fire the engine 20.

In accordance with the present invention, the fuel, after being introduced into the airflow and mixing with the air, on passage of the mixture out of the carburetor, the mixture passes through the precombustioning conditioning device 22 in moving into the engine intake manifold 28.

Figure 2:
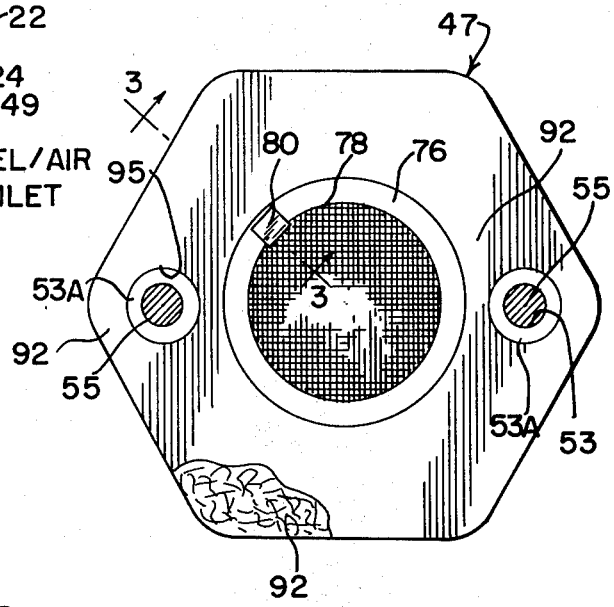
FIG. 2 is a top plan view of the device of FIG. 1, shown on an enlarged scale, and as mounted in operating position, with the carburetor omitted, the top seal being broken away, and the securing bolts shown in section.
Figure 3:
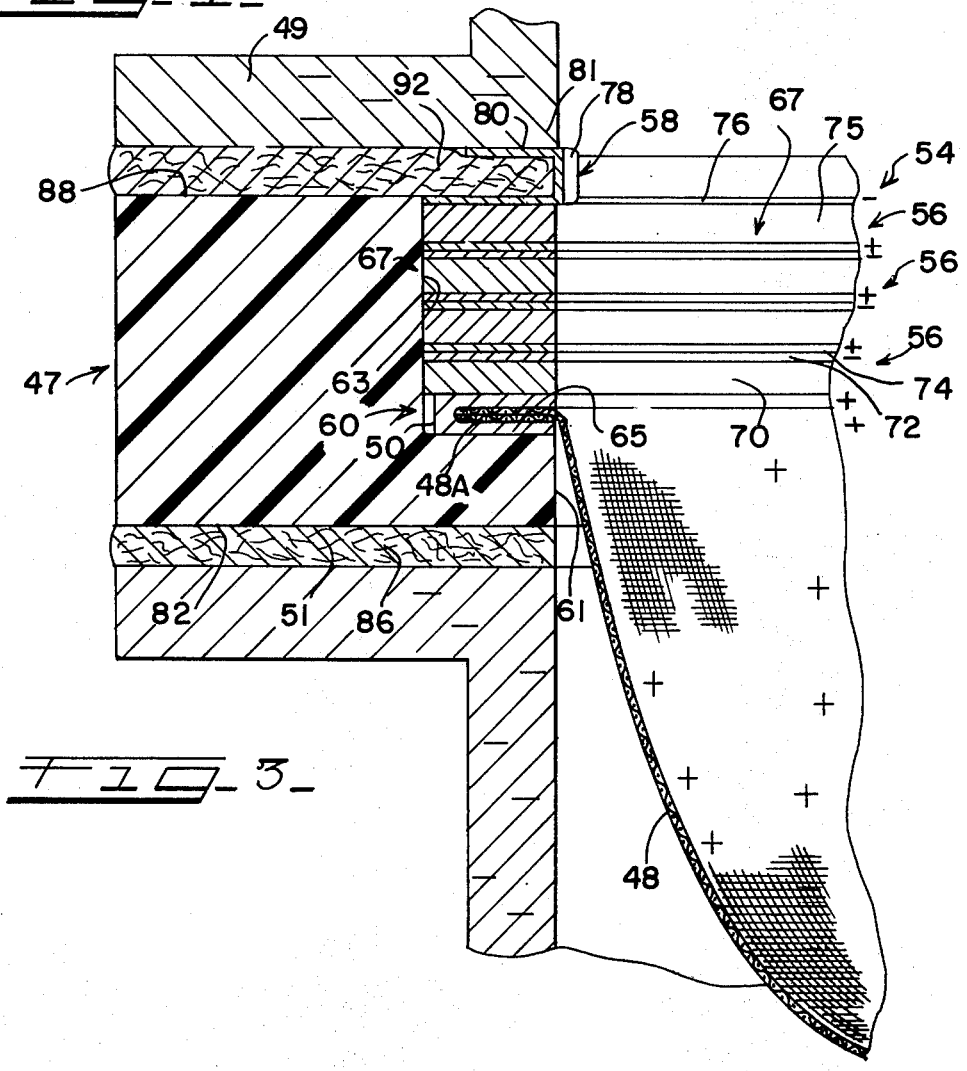
FIG. 3 is a fragmental cross-sectional view of the device shown in FIG. 2, taken substantially along line 3—3 of FIG. 2, and showing the gasketing in largely block diagram form.
Figure 4:
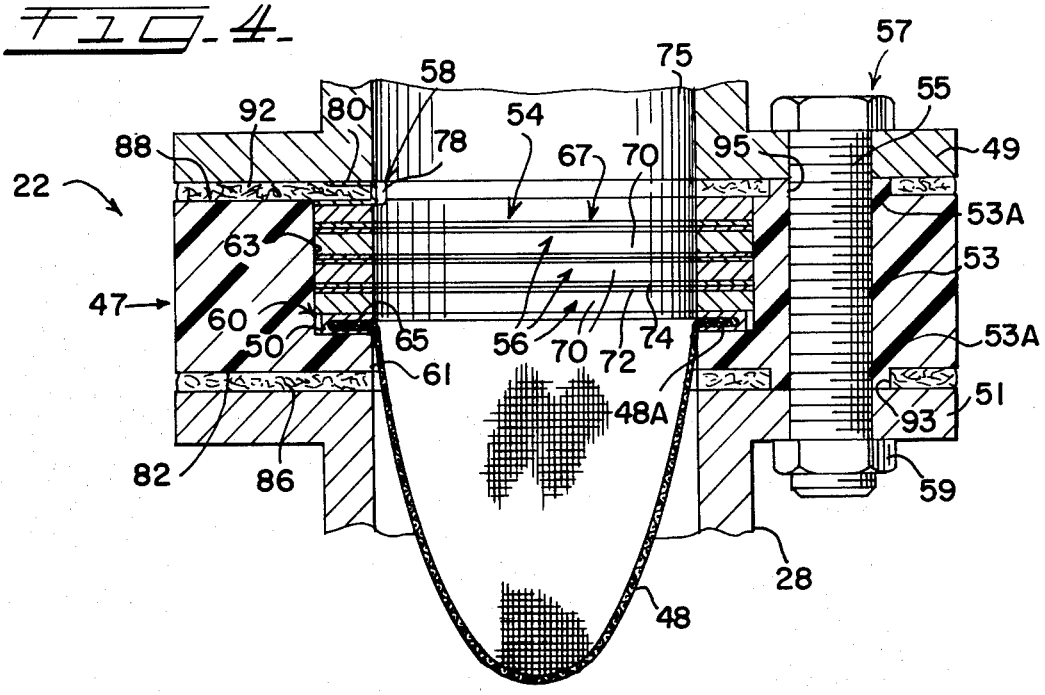
FIG. 4 is a view similar to that of FIG. 3, but showing the full section along a line angled through a securing bolt, and being on a smaller scale.

Referring now specifically to FIGS. 2–4, the device 22 comprises a generally flat or planar rigid, or semi-rigid, carrier member 47 formed from a suitable heat and moisture resistant electrically insulating material (such as a high temperature asphaltic plastic or an asbestos filled phenolic resin), formed by uitlizing conventional molding procedures, which is shaped to conform to the marginal outline of the carburetor and manifold flanges 49 and 51 between which it is received for mounting the device in its operative position. Carrier member 47 is shaped to defined, in the form shown, a pair of mounting bolt receiving openings 53 for receiving the respective bolts 55 of bolt and nut devices 57 may be arranged to clamp the carrier member 47 between the carburetor and the manifold in the manner indicated in FIGS. 3, 4 and 7. Carrier member 47 is bossed at 53A about the respective openings 53.

The carrier member 47 is open centered in configuration, it being formed to define bore 61 and counterbore 63, the latter defining within the carrier member 47 an annular ledge of shoulder 65 on which is mounted a foraminous member in the form of a screen 48 that is shaped to define a flange portion 48A to which is secured a grommet or ferrule 50. Also received within the socket 67 that is defined by the carrier member counterbore 63 and shoulder 65 is a battery assembly 54, which includes a plurality of stacked battery units 56.

The device 22 further includes a negative terminal 58, with the grommet or ferrule 50 serving as the battery positive terminal 60.

The screen 48 is preferably formed from an electrically conductive metal such as steel, copper, stainless steel, or other suitable ferrous or non-ferrous metallic substance that is electtically conductive. In accordance with the present invention, the screen 48 is plated with a metal that in the presence of hydrocarbons induces by a catalytic effect oxidation of hydrocarbons, thereby generating sufficient heat to avoid ice build up in the screen, as will be explained hereinafter. Metals suitable for this purpose are gold, platinum, and stainless steel of the 300 series stainless steel such as AL 362 ferritic stainless (stainless steels that resist oxidation and stay bright will provide the thermo catalytic effect involved).

The screen 48 in practice is in the form of a wire cloth having a mesh size in the range of from about 10 to about 30 mesh. By way of example, the screen 48 may be formed from 30 mesh wire cloth having about 1,000 openings per square inch with the wires having a thickness of 0.007 to 0.12 inch, so that the distance between wires across the mesh openings measures about 0.25 to 0.090 inch.

As indicated in FIGS. 3, 4 and 7, the screen is dished or cupped in the direction of fluid flow, and is shaped to define the aforementioned circumambient flange portion 48A to which the grommet or ferrule 50 is applied.

The grommet or ferrule 50 is formed from a suitable electrically conductive metal that is deformable for shaping in the manner indicated in the drawings, and that preferably is at the electropositive end of the replacement or electromotive series or classification of metals, which starting at the electronegative end of the classification is potassium, sodium barium, strontium, calcium, magnesium, aluminum, manganese, zinc, chromium, cadmium, iron, cobalt, nickel, tin, lead, trivalent ferritic stainless steel hydrogen, copper, mercury, silver, platinium and gold, in that order, with gold being at the electropositive end of the series or classification.

Thus, the grommet or ferrule 50 should be formed from such metals as nickel, copper, gold, platinium, or silver. Alternately, the grommet or ferrule can be formed from ordinary soft iron or steel and plated with one of the electropositive metals indicated, since what is essential is that the surfacing of the grommet or ferrule be of a metal that is at the electropositive end of the electromotive series referred to above.

As indicated in the drawings, the grommet or ferrule 50 is of U-shaped transverse cross-sectional configuration having the base of the U facing outwardly and the legs of the U crimped against the screen flange portion 48A.

The individual units 56 each comprise a layer 70 formed from a suitable electrolyte material and layers 72 and 74 formed from metals of dissimilar location on the aforementioned electromotive series.

The layer 70 may be formed from any commercially available electrolyte material forming substance, such as the glue/glycerin fiber sheet packing available from F. D. Farnam Co. that constitutes a harsh all-vegetable fiber paper sheet, such as, for example, a sheet of unbleached sulphate wood pulp to provide a body, (that is, to act as a filler), which is saturated with a high-test (315 grams Bloom) hide glue which now saturates the fiber sheet. A typical constitution for the layer 70 if formed from this material would be about 59 percent paper, about 7 percent animal glue, about 29 percent glycerin, and about 5 percent water by weight. The glycerin in the sheet, primarily due to its hydroscopicity, retains moisture and thereby accomplishes softening or plasticizing of the hide glue. The moisture held by the glycerin also plasticizes (that is, softens) the fibers constituted by the wood pulp.

Alternate materials sold for the purpose are the animal glue-glycerin sheet sold under the trademark VELLUMOID (by Federal Mogul Corporation of Detroit, Michigan); also blotting paper saturated with potassium and lithum hydroxide (as employed in nickel-cadimium batteries), and blotting paper saturated with zinc chloride (as employed in dry cells).

in any event, the material forming layer 70 is shaped in ring form to substantially complement the general outline of the grommet or ferrule 50 and thus provide an open centered configuration consistent with the operation of the present invention.

The layers 72 and 74 are similarly formed in ring shaped configuration, conforming to the ring shaped configuration of layer 70 (in general outline) from metals, with the layer 72 being formed from a electronegative metal on the negative side of the individual units 56, and the layer 74 being formed from an electropositive metal on the positive side of the individual units 56. For instance, layer 72 may be a ring formed from zinc and layer 74 may be formed from stainless steel of the ferritic trivalent types such as 416 stainless, or AL 362. When layers 72 and 74 are placed in contact they assume different potentials, known as contact potential, which has been explained as being a result of the electrons moving move readily in one direction than the other, and thus making one of the metals negative and leaving the other metal positive.

A unit 56 comprising the layers 70, 72 and 74 (using the metal materials suggested) will provide a battery action of 0.56 volt. Alternately units 56 can employ the following metal combinations with the resulting voltage: cadmium-nickel, 0.37 volt; zinc-nickel, 0.57 volt; nickel-tin, 0.53 volt; zinc-gold, 0.8 volt; cadmium-gold, 0.64 volt; and cadmium-stainless steel, 0.51 volt. The stainless steel employed for forming the electropositive element of a battery should be of the ferritic trivalent type.

Preferably, the metals selected for forming the layers 72 and 74 are located on the electromotive series to produce a 0.5 volt differential for the particular unit 56 involved, as measured between the screen 48 and the manifold. For small two or four cycle engines (i.e., those having a displacement of no more than about 25 cubic inches) a single unit 56 will provide adequate potential for a device 22, but for larger engines multiple units 56 are preferred to provide a combined potential of approximately 2 volts. As indicated, the metal forming layers 72 and 74 should be respectively electronegative and electropositive relative to each other.

In the form shown in FIG. 1, 4 and 7, three units 56 are in stacked series connected relation, with the third unit 56 having applied on top of some an electrolyte layer 75 which in turn has applied on same the negative terminal 58, which in the form shown comprises contact ring 76 formed from an electrically conductive material and shaped to define a tab 78 on its inner margin which has its upper portion 80 angled over in parallelism to the ring 76 to form a contact finger positioned to be engaged by the carburetor at its base 81.

Layer 75 is a ring of the same material as layers 70.

The ring 76 should be formed from an electronegative metal with respect to the electromotive metal series referred to above, such as zinc, or alternately be formed from mild iron or steel and plated with zinc or other electronegative metal.

The carrier 47 at its underside 82 is received against suitable sealing gasket 86, and at its upper side 88 has applied to same suitable sealing gasket 92. In the form shown, sealing gasket 92 has the tab 78 of ring 76 angled over against it to provide substance below the tab portion 80 to resist downward deflection of same when the device 22 is mounted in its operative position. Gaskets 86 and 92 are formed with paired openings 93 and 95, respectively, proportioned to closely receive the respective bosses 53A.

The gaskets 86 and 92 may be formed from any suitable type of gasketing substance or material such as wood fibers, synthetic and/or natural rubbers, cork, asbestos, or suitable plastic materials. The function of gaskets 86 and 92 is strictly to provide a sealing action and they may be either electrically conductive or insulative, and may be heat conductive or insulative or noninsulative, as desired.

The gaskets 86 and 92 may optionally be bonded to the carrier member 47, but preferably are physically separable to permit replacement of the basic components of the device 22 as found to be desirable or necessary in use.

In this connection, units 22 may be supplied with several sets of these seals 86 and 92 to adapt the particular device 22 to fit different makes of automobiles.

In use, the device 22 is applied to the vehicle in the manner indicated in the drawings, that is, between the vehicle carburetor and its intake manifold, with the nut and bolt assemblies 57 being employed to clamp the carburetor and manifold flanges 49 and 51 against the seals 86 and 92, and thus against the carrier member 47, in the manner indicated in the drawings following conventional torque applications suitable for contemporary carburetor design. The bosses 53A serve as stops limiting the displacement of the gaskets under the compressive forces involved and avoiding compression of the assembly 54 and screen flange beyond that which insures good electrical contact. Also, too much pressure on the battery assembly will force the electrolyte material out of the electrolyte layers. The member 47 may also be indented, to serve this pressure limiting purpose, as disclosed in said application. With the components of the device 22 applied to the carrier member 47 in the manner indicated in the drawings, the screen 48, grommet or ferrule 50, the units 56, the layer 75, and contact ring 76 are series connected to give the screen 48 and grommet or ferrule 50 a positive potential and the ring 76 a negative potential. Assembly of the device 42 in its operative position shown in the drawings grounds the contact ring 76 through the carburetor and bolts 55 to the manifold 28. The units 56 form an electrogenetic device for generating the potentials indicated, whereby screen 48 is positively charged and the manifold is negatively charged, as indicated in FIGS. 3 and 7.

The screen 48 is preferably dished in the direction of fluid flow through the carburetor and manifold, and thus through the device 22, so as to present a concave configuration facing upstream and convex configuration facing downstream. The dished or cup shape employed may be substantially conical or more closely approaching an elongated hemispherical configuration, the latter being shown in FIGS. 3, 4 and 7.

Figure 5:
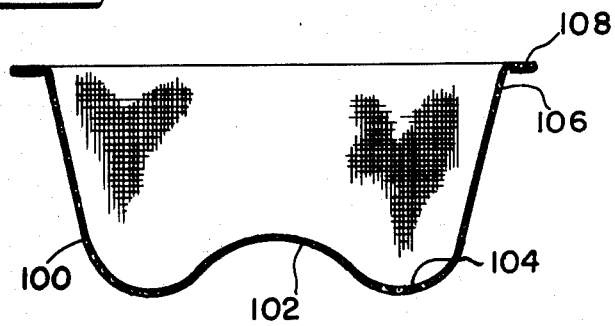
FIG. 5 is a sectional view of a modified form of screen for use in connection with the invention.

In the alternate form of FIG. 5 the screen 100 is made re-entrant at its lower portions such that its central portion 102 has is bent upwardly into a dome configuration so that it faces the impinging air fuel mixture and is above an annular depression 104 formed in the screen between its center dome portion 102 and the outer edge 106. The outer edge 106 is flanged as at 108 in a manner comparable to screen 48 for application thereto of a grommet or ferrule 50.

The screen configuration shown in FIG. 5 provides a fluid flow configuration against and through the screen which improves the dispersion and mixture of the fuel-air mixture. Screen 100 is, of course, mounted in the manner shown for screen 48 for positive charging in accordance with the invention.

Tests have shown that an automobile engine equipped with precombustion conditioning device 22 electrically connected as indicated to charge the screen 48 positively and the engine ground, represented by the manifold 26, negatively, will operate to increase gasoline mileage, reduce the presence of undersirable pollutants in the exhaust, and lower the octane reading of the gasoline required to prevent knocking.

During operation of the vehicle, the passage of fuel particles through the screen 48 imparts a positive electrostatic charge of the contact transmitted type, to the fuel particles, which positive charge causes the particles involved to repel each other and be electrostatically attracted to the negatively charged metal walls of the manifold where they impinge and flatten out against the manifold surfaces involved for maximum exposing of the liquid surface area to the air turbulence involved, resulting in thorough vaporization of the fuel in the fuel-air mixture. This action also occurs in the engine block passages upstream of the respective cylinders to the extend that any liquid particles pass through the manifold.

This electrostatic action on the fuel particles in both spreading out the individual fuel particles relative to each other and individually into a thin layer over against the intake manifold and engine surfaces involved makes it possible for the turbulent air flow conditions and partial vacuum conditions involve as well as the temperature of the air surfaces involved to effect substantially full vaporization of the fuel in the air fuel mixture. This fuel particle charging by contact has the advantage of maximum charging speed and minimum voltage requirements, as distinguished from field effect charging systems (involving passing the particles between spaced electrodes). It has been found, for instance, that a screen charge of 2 volts is ordinairily adequate for practice of the present invention in connection with four cycle engines used in automobiles and boats while thousands of volts are required for field effect systems. For small too and four engines having a displacement up to about 25 cubic inches, a screen charge of 0.5 volts has been found to be adequate for the practice of the invention.

As unvaporized fuel does not combust as uniformly and completely as vaporized fuel, the increase achieved by the invention in the amount of fuel vaporization prior to reaching the engine cylinders insures improved combustion efficiency.

Furthermore, unvaporized gasoline particles in moving from the carburetor into the engine cylinders have a tendency to flow from the carburetor into the cylinders that are the closest to the carburetor. This tends to provide such cylinders with a mixture of air and gasoline that has more gasoline in it than the cylinders which are further away; in fact, the cylinders furthest from the carburetor tend to be fuel starved. By improving the vaporization of the gasoline fuel in accordance with the invention, the fuel is distributed to each cylinder more uniformly to again improve efficiency as well as to achieve more cleaner running. The result is that the engine runs smoother and on less gasoline when the invention is employed.

The device 22A of FIG. 7 is the same as device 22 except that a second foraminous member in the form of a screen 48 and associated grommet or ferrule 50 are employed, with the second screen and its associated grommet or ferrule being stacked in series connection with the units 56 and at the positive side of the battery assembly provided.

FIG. 7 also illustrates diagrammatically the manner in which the charged fuel particles separate and impinge or impact against the negatively charged manifold surfaces to physically flatten out in a dispersed manner for rapid evaporation, due to fuller exposure to the air flow involved and the heating by the manifold as the latter heats up in service, thereby effecting more complete vaporization of the fuel. The flattening of the liquid fuel particles against the charge manifold walls is aided by the fact that as the positively charged particles near the negatively charged surfaces involved, the electrostatic attraction between them increases exponentially (a square law function is involved), which also has a spreading out effect on the individual particles involved. Thus, both the electrostatic effect and the physical impact effect involved are active in thinning down the fuel particles to a desired high surface to volume ratio for maximum evaporation effect. The fuel particle impinging action provided by device 22 is similar to that depicted by FIG. 7.

Another significant improvement provided by the invention is concerned with the aforementioned plating of the screens 48 with metals known to have oxidizing catalytic effects. As indicated, examples are gold, platinmum and ferritic trivalent type stainless steel. Under ordinary operating conditions the flow of air through the mesh of the screen or screens involved will prevent the oxidizing catalytic effect from raising the temperature of the individual screens involved to any significant extent. However, when ice begins to form on the screen wires, the ice, of course, covers the wire and thus prevents the fuel-air flow from cooling the wire. As the hydrocarbon materials adjacent to the plated screen wires (entrapped in the ice) will then begin to generate enough heat to melt the ice immediately next to the wire, the result is that the icing is in the form of a thin ice shell with liquid in the center of same about the wire involved. The force of the fuel-air flow through the screening then breaks up the thin ice shells involved, whereby building up of sufficient ice to cause appreciable operating problems is prevented.

This de-icing effect provided by the invention is important in preventing the icing in a carburetor venturi due to the latent heat of vaporization in cooling an air-gasoline mixture with a high moisture content to the point of depositing ice build-ups that can actually choke off and stop internal combustion engine.

Figure 6:
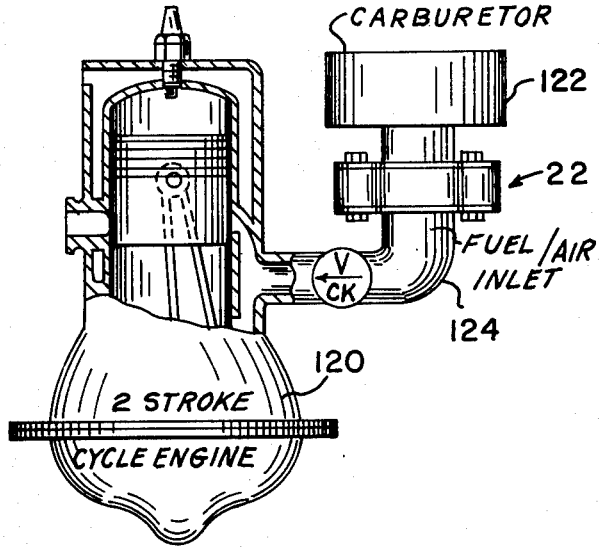
FIG. 6 is a view similar to that of FIG. 1 but showing the device of FIGS. 1–4 operably associated with a two stroke cycle internal combustion engine, with the engine being partially broken away.

The devices 22 and 22A may also, as already indicated, be utilized in connection with two stroke cycle engines, such as, for instance, the marine outboard engine 120 illustrated in FIG. 6. As is well known, in a two stroke cycle engine, oil is added to the gasoline, the oil being a lubricating oil which after traveling into the engine with the gasoline, lubricates the engine valves and pistons. The oil, due to its high mole weight, does not vaporize readily, and thus does not burn well, if at all, in the engine combustion chambers. The oil involved which does not adhere to the surfaces to be lubricated is largely exhausted through the outlet manifold and thus forms a source of pollution.

However, by employing a device 22 or 22A in connection with the engine 120, it has been found that the oil involved largely tends to deposit on the surfaces desired to be lubricated on the way into the engine combustion zone. The end result is that the amount of oil exhausted from the engine is very substantially reduced, as compared to engines 120 not so equipped, this being in addition to the efficienccy of operation and benefits in gasoline consumption secured from the use of the devices 22 and 22A in connection with the motor 120.

As indicated in FIG. 6, the device 22 there illustrated in interposed between the outlet for the carburetor 122 and the inlet for the motor intake manifold 124. The fine particles of lubricating oil in the fuel-air mixture, due to the operation of the device 22 (assuming it is operatively connected, for instance as shown in one of FIGS. 2–6), coat the engine surfaces downstream of the device 22. The oil particles are thus charged by the device 22 to a positive potential so as to be attracted to the negatively charged engine surfaces. Since the oil particles are somewhat heavier than the fuel particles, they will be attracted to the motor surfaces further downstream from the device 22 then those to which the fuel particles are attracted.

FIG. 9 illustrates an embodiment 22B of the invention wherein the contact ring 76 of FIG. 3 has been replaced by ring 76A of similar material, which has a tab 130 that extends up through an opening 132 formed in the seal 92A, and which has an end portion 134 that engages the carburetor flange 49 when the device 22B is mounted in the engine, in the manner already described.

It will therefore be seen that the invention provides a simplified type of precombustion conditioning device best used in operative association with gasoline fired internal combustion engines by being interposed between the carburetor and the engine fuel intake passages, as, for instance, in one of the manners shown in the drawings. The device is of few and simple non-moving parts, is sturdily constructed, and lends itself to automated assembly from low cost parts. The device is entirely self-contained, including its own source of DC power for charging the device screen or screens positive and the engine manifold negative.

The electrical circuit provided involves the movement of electrons through the circuit whereby as the liquid fuel particles engage the screen or screens of the device, they lose electrons and become positively charged. The electrostatic forces involved bring the charged fuel particles against the negatively charged manifold, in the manner described hereinbefore and illustrated in FIG. 7.

The current flow of the "load" circuit provided by the gasoline particles traversing the space between the device screen or screens and the manifold walls preferably has a current flow in the range of from about 0.1 to about 2 microamps, depending on the resistance provided in the electrical circuiting employed. A current of one microampere will have the result of drawing off $6 \times 10^{12}$ electrons from gasoline liquid particles engaging the screen or screens of the device employed. Pursuant to the invention the movement of electrons involved should be out of the gasoline particles, when they make contact with the screens involved in the device, so that the "load" circuit consists of electron deficient gasoline particles traversing the space between the device screen or screens where the electron deficiency is established, and the manifold walls to which the electron deficient particles are attracted to complete the "load" circuit.

The devices 22 and 22A are arranged for ready removal and replacement of the battery units 56, as may be necessary after extended periods of use, due to the gradual erosion of the electronegative metal elements of the individual units 56 as a result of the electrogenetic battery action involved. Thus, it is merely necessary to remove the carburetor and replace the components within carrier member 47, as may be needed, with the components involved readily slipping into and out of place. Reapplication of the carburetor, after the change is completed, in the manner indicated in the drawings, readies the revitalized device 22 or 22A for continued use.

The device 22 employing four units 56 utilizing ferritic trivalent stainless steel and zinc as the layers 72 and 74 will produce about 2.25 volts between the device screen and the manifold walls.

Since the electrolyte material is not part of the structural aspects of the device, the electrolyte material can be selected based on its electrical performance without regard to its structural component of the device that is socketed to receive the non-structural components that make up the individual battery units. In accordance with this invention, the voltage generating components of the device do not provide mechanical structure to support the screen 48, and thus they are not subject to stress and strain that can interfere with the efficiency of the battery action to be provided.

The carrier member 47 can be proportioned depthwise to receive the number of units 56 as may be required for particular applications. For instance, for small engines (having a displacement of 25 cubic inches or less), a device 22 or 22A may employ a single unit 56 whereby all that is needed is a screen 48 with its grommet or ferrule 50, a single unit 56 consisting of layer 70, 72 and 74, and the ground electrode forming ring 76 in electrical contact with the single unit 56. As a matter of fact, since the surfacing of the grommet or ferrule 60 and the ring 76 are electropositive and electronegative metals, respectively, even the single unit 56 may be eliminated, as in the device 22B of FIG. 8, in favor of a simplified battery unit 56A comprising a single electrolyte layer 70 interposed between the grommet or ferrule 50 and the ground contact ring 76, with the carrier 47 being reduced in depth accordingly. Thus, the grommet or ferrule 50, the electrolyte layer 70 in contact therewith, and a contact ring 76 in contact with such electrolyte layer 70 will provide adequate battery action to make the resulting device operative for use in connection with small tow cycle engines.

The terms electropositive and electronegative as discussed with reference to the battery action of this invention mean that in selecting the metals to be employed for a particular battery unit, such metalls are selected with reference to the aforementioned electromotive series of metals such that the negative side of the battery will be metal that is positioned in the series on the negative side thereof with respect to the position in the series of the metal that is to form the positive side of the battery. Generally speaking, the further apart the metals selected are in the electromotive series, the higher the devoloped voltage will be (assuming similar resistances, etc.).

The foregoing description and the drawings are given merely to explain and illustrate the invention and the invention is not to be limited thereto, except insofar as the appended claims are so limited, since those skilled in the art who have disclosure before them will be able to make modifications and variations therein without departing from the scope of the invention.

I claim:

1. In a precombustion conditioning device for interposition between the carburetor and the fuel-iar inlet of a thermal combustion engine employing a vaporizable liquid fuel, said device including means for electric contact charging the liquid fuel particles of the fuel-air mixture including an electrically conductive foraminous member supported by electrically insulating means in and across the passageway from the carburetor to the fuel-air inlet against which the fuel particles engage, in combination with an electrically conductive surface in the path of flow of the fuel-iar mixture from the carburetor to the combustion zone of the thermal combustion engine downstream of said member, a source of electrical DC energy, means connecting the positive terminal of said source of said member, and means connecting the negative terminal of said source to said surface whereby the liquid fuel particles are contact charged positive on passing through said member and are impelled by electrostatic attraction to flatten against said surface for rapid evaporation, the improvement wherein:

said electrically insulating means comprises a carrier member formed from an electrically insulating material and disposed across the passageway, with said carrier being planar and defining a closed perimeter opening extending transversely of the plane thereof and extending therethrough that is aligned with the passageway.

said carrier member opening defining a socket in circummambient relation about the passageway.

said foraminous member defining a peripheral flange that is lodged in said socket.

an annular electrogenetic voltage producing assembly received in said socket and including a contact element engaging the carburetor and forming the negative terminal, said assembly comprising said source, and means for grounding the carburetor to said surface and comprising said connecting means.

2. The improvement set forth in claim 1 wherein:

said assembly and said foraminous member are removably mounted in said socket and are free of structural integration with said carrier member.

3. The improvement set forth in claim 1 wherein:

said member flange is received within a ferrule formed from an electrically conductive material and has its surfacing defined by an electropositive metal.

with said ferrule forming the positive terminal of the DC energy source.

4. The improvement set forth in claim 1 wherein:

said membeer comprises a screen, said screen having a surfacing including means for catalytically effecting generation of heat in the presence of hydrocarbons in the fuel-air mixture for de-icing of said screen.

5. In an electrostatic precombustion conditioning device for interposition between the carburetor and the fuel-air inlet of an internal combustion engine employing a vaporizable liquid fuel, said device including an electrically conductive screen member supported by electrically insulating means and disposed in and across the passageway from the carburetor to the fuel-air inlet, in combination with electrically conductive surfaces of the engine in and about the path of flow of the fuel-air mixture from the carburetor to the combustion zone of the internal combustion engine, and electrogenetic DC battery means for applying a positive electric charge to said member and a negative charge to said surfaces, whereby the liquid fuel particles present in the fuel-air flow from the carburetor are contact charged positive on engagement with the screen member so that said particles will be electrostatically attracted to said surfaces to assist vaporization of such particles, the improvement wherein:

said electrically insulating means comprises a carrier member formed from an electrically insulating material and disposed across the passageway, with said carrier being planar and defining a closed perimeter opening extending transversely of the plane thereof and extending therethrough that is aligned with the passageway, said carrier member being counterbored to define about said opening a socket in circumambient relation about the passageway, said screen member defining a peripheral flange that is received in said socket, and an annular electrogenetic voltage producing assembly received in said socket about the passageway and comprising said battery means, said assembly having a positive terminal electrically connected to said screen and a negative terminal grounded to said surfaces.

6. The improvement set forth in claim 5 wherein:

said assembly and screen are removably mounted in said socket and are free of fixed connection to said carrier.

7. The improvement set forth in claim 5 wherein said assembly comprises:

a stack of one or more electrogenetic voltage producing units each comprising:

a first layer of an electropositive metal, a second layer of an electronegative metal, engaging said first layer, with said first layer engaging a layer formed from an electrolyte material, with said units being connected in series from positive to negative, said screen member flange being received within a ferrule formed from an electrically conductive material and having its surfacing defined by an electropositive metal, with the electrolyte layer of the lowermost of said units engaging said ferrule, said ferrule forming said assembly positive terminal.

8. The improvement set forth in claim 5 wherein:

the engine has a displacement of 25 cubic inches or less and the screen member has a positive charge of at least about 0.5 volts.

9. The improvement set forth in claim 5 wherein:

the engine has a displacement in excess of 25 cubic inches and the screen member has a positive charge of at least 2 volts.

10. The improvement set forth in claim 5 wherein:

said screen has a surfacing including means for catalytically effecting generation of heat in the presence of hydrocarbons in the fuel-air mixture for de-icing of said screen.

11. The improvement set forth in claim 5 wherein:

said screen surfacing means comprises a material selected from the group consisting of gold, platinum and stainless steel.

12. The improvement set forth in claim 7 wherein:

said battery means during operation of the engine has a current in the range of from about 0.1 to about 2 microamps.

13. The improvement set forth in claim 5 including:

a second screen member spaced from said first screen member and supported by said carrier member and disposed in and across the passageway.

said second screen member being electrically connected to said positive terminal.

said screen members being dished in the direction of the path of flow of the fuel-air mixture.

14. The improvement set forth in claim 5 wherein:

said electrically conductive surfaces of the engine are defined in part by a fuel-air intake manifold secured to the engine and placing the passageway in communication with the engine fuel-air inlet, said carrier member being clamped between the carburetor and the manifold.

15. The improvement set forth in claim 14 including:

seal means interposed between the manifold and said carrier, seal means interposed between the carburetor and said carrier member, and stop means integral with said carrier member for limiting compression of said seals.

16. The improvement set forth in claim 15 wherein:

said assembly includes a contact ring formed from an electrically conductive material and having its surfacing defined by an electronegative metal, said contact ring being series connected between said assembly and the carburetor and forming said assembly negative terminal.

17. The improvement set forth in claim 5 wherein:

said assembly includes a contact ring formed from an electrically conductive material and having its surfacing defined by an electronegative metal, said contact ring being series connected between said assembly and the carburetor and forming said assembly negative terminal, said screen member flange being received within a ferrule formed from an electrically conductive material and having its surfacing defined by an electropositive metal, and electrically conducting means series connecting said screen member flange and said contact ring,

18. The improvement set forth in claim 17 wherein: said assembly electrically conducting means comprises one or more battery units.

19. The improvement set forth in claim 17 wherein: said assembly electrically conducting means consists of a layer of electrolyte forming material series connecting said flange and said contact ring.

20. In a combustion conditioning device for interposition between the carburetor and the fuel-air inlet of a gasoline fired internal combustion engine and across the fuel-air passageway defined by the carburetor and inlet, said device comprising:

an electrically conductive screen member supported by electrically insulating means and adapted to be disposed in and across the passageway from the carburetor to the fuel-air inlet, electrogenetic DC battery means for applying an electric charge to said screen member, said electrically insulating means comprising a carrier member formed from an electrically insulating material, with said carrier member being planar and defining a closed perimeter opening extending transversely of the plane thereof and extending therethrough that is adapted to be aligned with the passageway, said carrier member being formed to define about said opening a socket in circumambient relation about said opening, said screen member defining a peripheral flange that is received in said socket, and an annular electrogenetic voltage producing assembly received in said socket about the opening and comprising said battery means, said assembly being electrically connected to said screen and having a terminal adapted to be grounded to the engine.

21. The improvement set forth in claim 20 wherein: said screen member is supported from said carrier member by said flange thereof engaging in said socket, with said screen member being free of supporting connection to said assembly whereby said assembly is free of mechanical stress due to stress applied to said screen member.

22. The improvement set forth in claim 20 wherein: said screen is generally conical and is formed with a reentrant portion at its center.

23. The improvement set forth in claim 20 wherein said assembly comprises:

a stack of one or more electrogenetic voltage producing units, with said units being contact connected in series, said screen member flange being received within a ferrule formed from an electrically conductive material, with the lowermost of said units engaging said ferrule.

24. The improvement set forth in claim 20 wherein: said screen member has a surfacing including means for catalytically effecting generation of heat.

25. The improvement set forth in claim 24 wherein: said screen surfacing means comprises a material selected from the group consisting of gold and platinum.

26. The improvement set forth in claim 20 wherein: said battery means during operation of the engine provides said screen member with a charge of about 2 volts.

27. The improvement set forth in claim 20 including: seal means adapted to be interposed on either side of said carrier member for sealing the passageway.

28. The improvement set forth in claim 20 wherein: said assembly includes a contact ring formed from an electrically conductive material, said contact ring being series connected to said assembly and adapted to be series connected to the carburetor.

* * * * *